US007431173B2

(12) United States Patent
Thorpe

(10) Patent No.: US 7,431,173 B2
(45) **Date of Patent: *Oct. 7, 2008**

(54) INTERMEDIATE BULK CONTAINER WITH PALLET AND POLE SUPPORTED UPPER MEMBER

(75) Inventor: John Richard Thorpe, Darnall (ZA)

(73) Assignee: Almar Packaging International Inc., Umhlanga Rocks (ZA)

( * ) Notice: Subject to any disclaimer, the term of this patent is extended or adjusted under 35 U.S.C. 154(b) by 641 days.

This patent is subject to a terminal disclaimer.

(21) Appl. No.: 10/497,307

(22) PCT Filed: Nov. 29, 2002

(86) PCT No.: PCT/ZA02/00193

§ 371 (c)(1),
(2), (4) Date: Jun. 1, 2004

(87) PCT Pub. No.: WO03/045817

PCT Pub. Date: Jun. 5, 2003

(65) Prior Publication Data

US 2005/0045639 A1 Mar. 3, 2005

(30) Foreign Application Priority Data

Nov. 30, 2001 (ZA) ..... 2001/9882

(51) Int. Cl.
*B65D 88/52* (2006.01)

(52) U.S. Cl. ..... 220/9.4; 220/1.5; 206/511; 206/600

(58) Field of Classification Search ..... None
See application file for complete search history.

(56) References Cited

U.S. PATENT DOCUMENTS 3,255,927 A * 6/1966 Ruppert, Jr. et al. ..... 222/143
3,762,343 A * 10/1973 Thacker ..... 108/53.3
5,025,925 A * 6/1991 Wiklund ..... 206/386
5,154,286 A * 10/1992 Gits ..... 206/386
5,437,384 A * 8/1995 Farrell ..... 220/1.5
6,394,296 B1 * 5/2002 Elvin-Jensen et al. ..... 220/6
D476,814 S * 7/2003 Thorpe ..... D3/314
D492,460 S * 6/2004 Thorpe ..... D34/38

FOREIGN PATENT DOCUMENTS

| | | |
|---|---|---|
| DE | 83 26 463 | 11/1983 |
| EP | 0 589 483 | 3/1994 |
| EP | 0 894 728 | 2/1999 |
| GB | 896 733 | 5/1962 |
| GB | 1 315 842 | 5/1973 |
| GB | 2 189 773 | 11/1987 |

* cited by examiner

*Primary Examiner*—Stephen J. Castellano
(74) *Attorney, Agent, or Firm*—Young & Thompson

(57) ABSTRACT

An intermediate bulk container comprising a storage container which is made from a suitable flexible material, a forklift pallet base including pole engaging formations on its upper surface which are arranged about its periphery, a plurality of poles the lower ends of which are releasably engageable with formations on the pallet base to provide a support cage for the storage container, a holed pole location member including pole engaging formations with which the upper ends of the poles are engageable to lock the poles together to inhibit transverse outward bulging of the storage container from between the poles and to preserve the container support cage against a load in the storage container with the underside of the pallet base and the upper surface of the pole locating member including formations, which are releasably engageable with compatible formations on containers below and above it in a stack.

4 Claims, 6 Drawing Sheets

INTERMEDIATE BULK CONTAINER WITH PALLET AND POLE SUPPORTED UPPER MEMBER

FIELD OF THE INVENTION

This invention relates to a knock-down intermediate bulk container of the type which comprises a bulk storage bag which is made from a flexible material for containing particulate material, discreet objects or liquid and a support structure in which the bag is located to inhibit lateral bulging of the loaded bag in use.

BACKGROUND TO THE INVENTION

The bag support structure of most known containers of the above type consist of peripherally spaced side beams which extend between top and bottom panels of the container for the purpose of minimising transverse bulging of the container bag wall in use.

The top and bottom panels of the various containers are made from a flexible material which could be that from which the container bag is made, a corrugated cardboard, timber, plastic or metal.

The container side beams are made from corrugated cardboard which is formed into side wall support panels or elongated posts, timber panels, plastic or metal posts and the like.

Typical intermediate bulk containers of the above type are disclosed in the specifications of the following patents: U.S. Pat. No. 6,113,270, and U.S. Pat. No. 5,025,925.

Problems associated with all known containers of the above types, other than perhaps those of the rigid box type, are that:

(a) the containers are difficult to stack and when stacked result in an unstable stack structure. This is principally due to the flexibility of the container bags and the fluid nature of their contents which they generally contain, (b) a further difficulty with the stacking of these containers, particularly when they are filled with a high density material such as granular fertilizer, liquids and so on, is, if they are at all stackable, that the vertical load of the upper containers in the stack is transferred directly through the material in the container bags to the lower containers in the stack. This vertical load transmission could in many cases exceed the hoop strength of the reinforcing side beams and the flexible bag material between them to destroy the lower containers in the stack unless the materials from which the container components are made are expensively over-designed compared to what would be required in a single free standing container. Normally, to avoid this problem, the containers are stacked in stacks having a low vertical height with this necessitating large areas of warehouse store space in which the containers are to be stored. This becomes a highly expensive problem when the containers contain processed fresh produce which is stored and frozen in suitably insulated and refrigerated storage facilities. Additionally, it would certainly be unwise to attempt to convey, by means of a forklift or the like, even two of the containers which are stacked one on the other without the provision of at least some form of side support for the containers on the forklift tines, and (c) the containers for various products are generally designed by variation of their bag material and the circumferential spacing between and the nature of the side beams, to be specific to a designated load material having a specific density. This problem makes it necessary for the organisation which fills the container bags with various materials to expensively keep in stock container types suited to the transportation and storage of the various materials.

SUMMARY OF THE INVENTION

An intermediate bulk container according to the invention comprises a storage container which is made from a suitable flexible material, a forklift pallet base including a plurality of pole engaging formations on its upper surface which are arranged in a spaced relationship about its periphery, a plurality of poles, the lower end of each of which is releasably engageable with a pole engaging formation on the pallet base to be perpendicular to the general plane of the upper surface of the pallet base to provide a support cage for the container, and a centrally holed pole location member including a plurality of pole engaging formations with which the upper ends of the poles are releasably engaged to lock the upper ends of the poles together to inhibit transverse outward bulging of the container from between the poles and to preserve the integrity of the container support cage against transverse loads imposed on it by a load in the container, with the underside of the pallet base and the upper surface of the pole locating member including interengageable formations which are releasably engageable with compatible formations on intermediate bulk containers below and above it in a stack to prevent horizontally transverse dislocation of one container from another in the stack.

The pallet base may be square or rectangular in plan and is moulded from a suitable plastics material. The pole locating member has the same shape in plan as the pallet base and is moulded from plastic material. Preferably both the pallet base and the pole locating member are moulded to be hollow.

The pole engaging formations on the pallet base and the pole location member are preferably sockets in which the end portions of the poles are frictionally engaged, in use, to inhibit skewing of the poles relatively to the components with which they are engaged. Conveniently, the pole location member includes outwardly projecting formations which face the pallet base and through which the pole sockets pass into the member to increase the length of the sockets in which the upper end portions of the posts are frictionally engaged, in use. A portion of the lengths of the pole sockets in the pallet base, from their mouths in the upper surface of the pallet base, may be dimensioned and shaped to receive the pole location member projecting formations when the pole location member is placed on the pallet base.

The upper surface of the pallet base may include, between the pole sockets, elongated recess in which poles may be stored and trapped by the pole location member when the pole location member is placed on the pallet base.

The pallet base and the pole location member conveniently each include sixteen pole engaging sockets which are arranged in sets of five alongside each of their four outer edges with the corner sockets each being common to two sets of sockets. The central socket of each of the four sets of sockets may be positioned closer to the centre of the pallet base and pole location member with the remaining sockets in each set being aligned and parallel to an outer edge of the pallet base and pole location member outwardly of its central socket.

The poles could be made from metal with their upper and lower ends being rounded with the bases of the sockets in the pallet base and pole location member in which they are located, in use, being complementally shaped to the rounded pole ends.

When a plurality of loaded bulk containers are stacked vertically one on the other with their dislocation preventing formations engaged with those of a vertically adjacent container in the stack their posts are preferably in axial alignment with their ends separated from each other by solid material from which the pallet bases and the pole locating members are made so that the mass of the loaded containers above the base container of the stack is conveniently transmitted from their pallet bases only through the axially aligned poles to the surface on which the containers are stacked and not through the material in their storage containers. The bases of the sockets in the pallet base may be defined by plugs which are made from a plastics material which has a greater creep resistance than the material from which the pallet base is made and which are located in the sockets to extend between the lower ends of the poles located in them, in use, and the load bearing under surface of the pallet base.

The pallet base conveniently carries a central load discharge aperture. The pallet base may further include a plug for closing the discharge aperture from the underside of the pallet with the side of the plug including formations which are releasably engageable in formations in the wall of the pallet base aperture releasably to lock the plug in the aperture.

The pallet base may include in its underside two pairs of parallel sided forklift tine recesses with one pair of recesses extending across the pallet base from opposite sides of the base and the other pair from the remaining opposite sides to define four corner load supporting plinths and a single elongated plinth between each pair of corner plinths. The dislocation preventing formations on the pallet base are preferably elongated recesses in the undersides of the elongated load support plinths.

The dislocation preventing formations on the pole location member may be formations which project upwardly from the upper surface of the member and are substantially complementally shaped to the pallet base recesses so that when the bulk containers are stacked one on the other the formations on the pole locating members are releasably engaged in the recesses of the pallet bases of containers above them in the stack.

The pallet base and pole locating member dislocation preventing formations may have rectangular bases with each of the four sides of each formation tapering inwardly towards the opposite side of the formation.

The pole locating member may be a ring beam.

In one form of the invention the storage container may be a bag which is made from a suitable plastics film material. The thickness gauge of the film may lie in the range of between 90 and 120 microns.

The storage bag may be made from a woven plastics material. The woven bag material may in certain applications be internally laminated with a suitable plastic film for containing a liquid or highly hydroscopic particulate material.

The storage bag in yet a further version may be made from a netting material.

Any of the above storage bags may include parallel sleeves in its wall through which at least some of the cage poles may independently be located, in use. The sleeves may be dimensioned to receive pairs of adjacent poles.

The sides of the storage bag may be horizontally slit at vertically spaced intervals and on parallel lines about the side wall of the bag with poles being passed into and out of the slits on a vertical line so that the bag material on the outside of the poles will hold the bag wall to the poles.

Any of the above storage bags may include an outwardly projecting inlet tube which has a smaller cross-sectional dimension than the remainder of the bag. Additionally the bag may include an outwardly projecting outlet tube which has a smaller cross-sectional dimension than the remainder of the bag.

In another form of the invention the storage container may be moulded from a suitable plastic material and include a closable filling aperture and if required an outlet aperture.

A passive programmable microchip which is information accessible from an external electronic source may be embedded in a component of the bulk container.

BRIEF DESCRIPTION OF THE DRAWINGS

An embodiment of the invention is now described by way of example only with reference to the drawings in which.

DETAILED DESCRIPTION OF THE PREFERRED EMBODIMENT

Figure 1:
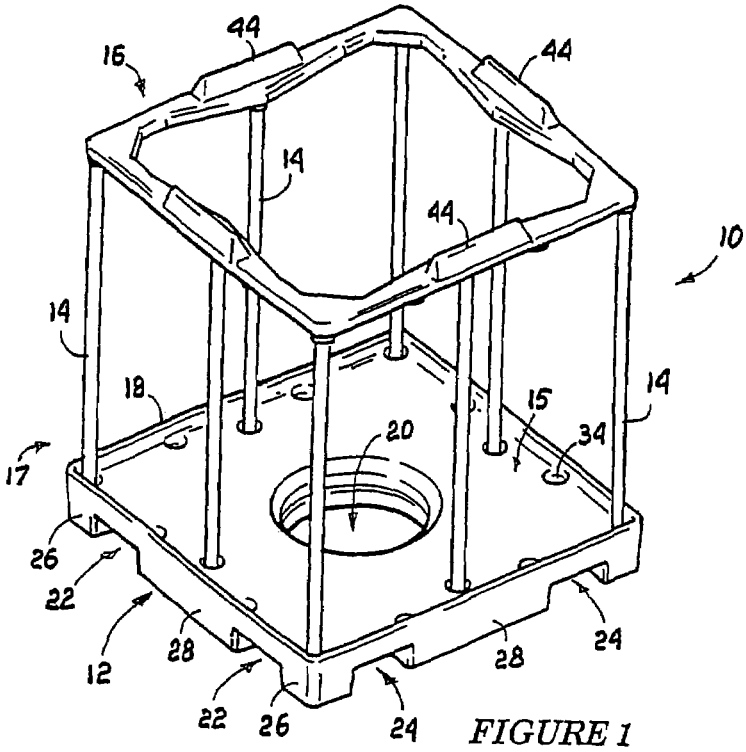
FIG. 1 is a perspective view from above of the intermediate bulk container of the invention.

The intermediate bulk container 10 of the invention is shown in the drawings to include a forklift pallet base 12, restraining poles 14 and a pole locating member or ring beam 16 which together provide a support cage 17 for a storage container.

The pallet base 12 is hollow rotor moulded from a suitable plastics material such as linear low density polyethylene and is most clearly shown in FIGS. 1, 2, 7 and 8 to include a flat upper surface 15, an upstanding peripheral rim 18 and a centrally located circular discharge aperture 20.

Figure 2:
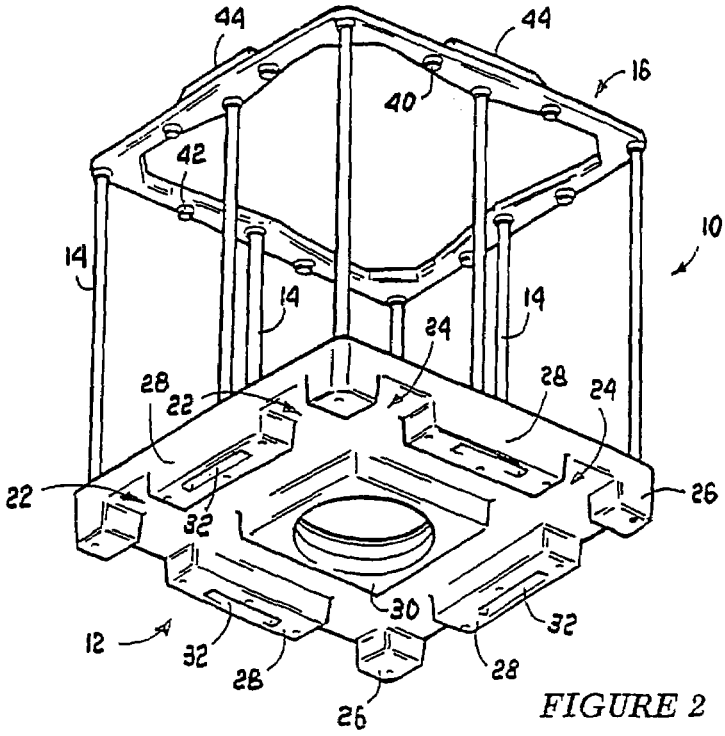
FIG. 2 is a perspective view from below of the bulk container.
Figure 8:
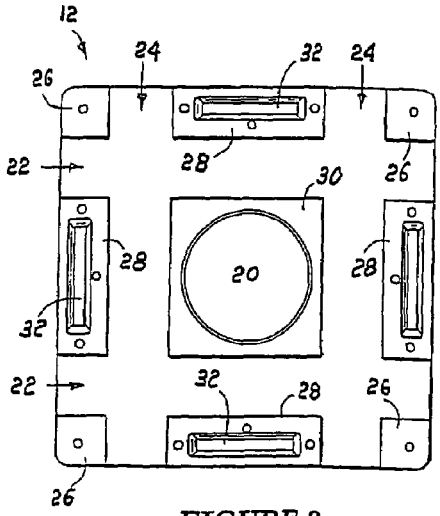

The underside of the pallet base, as is most clearly seen in FIGS. 2 and 8, includes two pairs of parallel sided recesses 22 and 24 with each pair of recesses being dimensioned and spaced to provide forklift tine recesses which are accessible from any one of the four sides of the pallet base. The pairs of recesses 22 and 24 define between them four substantially square corner support plinths 26, elongated support plinths 28 between the corner plinths and a shallower central protuberance 30 which carries the discharge outlet 20. The elongated intermediate support plinths 28 each carry an elongated recess 32.

Figure 7:
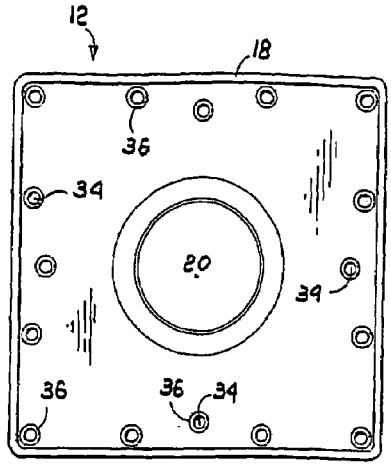
FIGS. 7 and 8 are respectively a plan view and an under plan view of the pallet base of the container.
Figure 10:
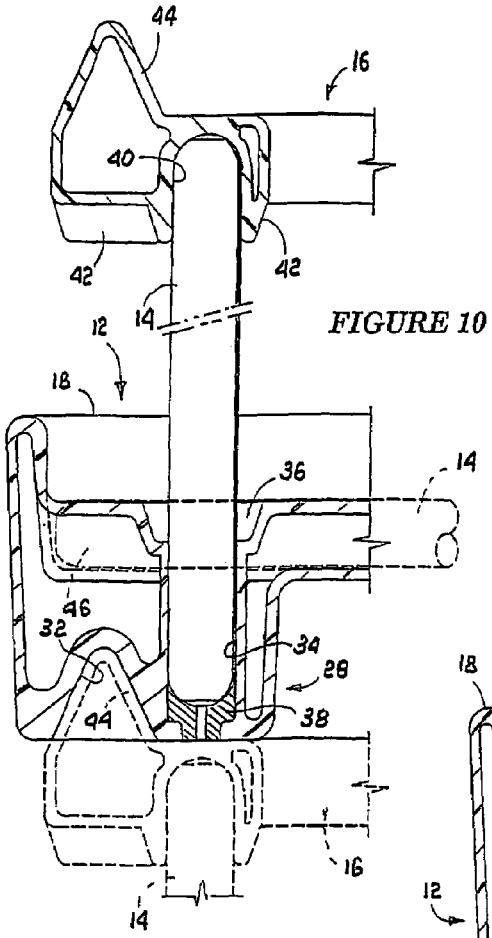
FIG. 10 is a fragmentary side elevation of the container shown sectioned on the line 10-10 in FIG. 3.

Returning to the upper surface of the pallet, it is shown in FIGS. 1 and 7 that the pallet includes 16 pole sockets 34 which are arranged in the upper surface as shown in FIG. 7 with each of the pole sockets being shaped as is most clearly seen in FIG. 10 to include a flared upper mouth portion 36 and a pole 14 which is located in the socket 34. Also, as shown in FIG. 10, each of the pallet base sockets 34 are located in either of the plinth supports 26 or 28 to provide the sockets with adequate depth solidly to frictionally engage the lower end of the poles 14 against skewing. The lower end of the socket is defined by a plug 38 which is located at the base of the socket 34, is made from a plastics material which has a higher creep resistance than that from which the remainder of the plastic material from which the pallet is made for competent load transfer between the end of the post and the underside of the plinth in which it is located. The plugs 38 are axially holed for water drainage should the knocked-down pallets be stored in the open.

Figure 3:
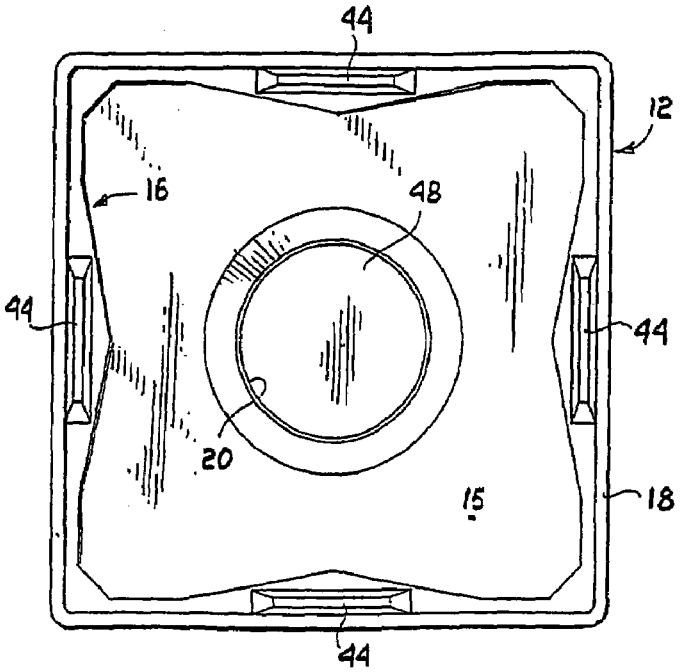
FIG. 3 is a side elevation of the bulk container.
Figure 4:
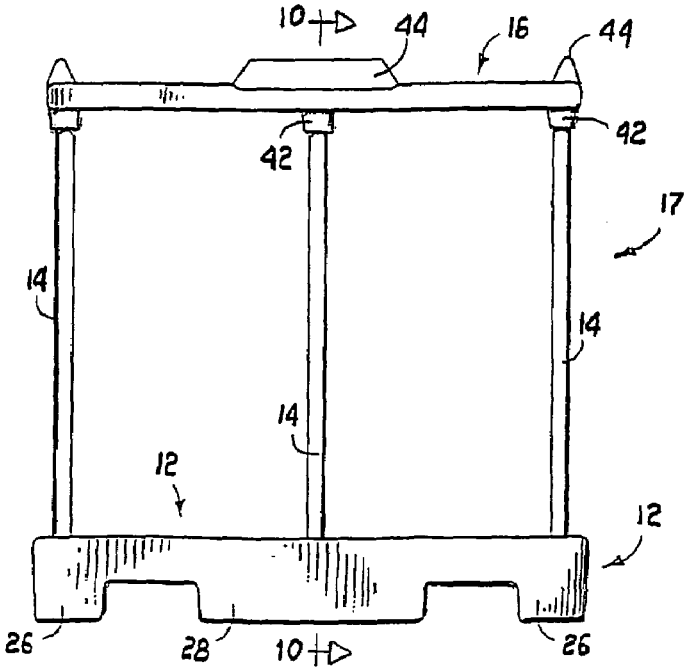
FIG. 4 is a plan view of the container.
Figure 6:
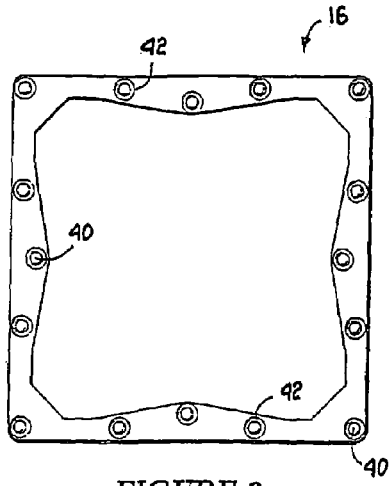
FIGS. 5 and 6 are respectively a plan view and an under plan view of the ring beam of the container.
Figure 5:
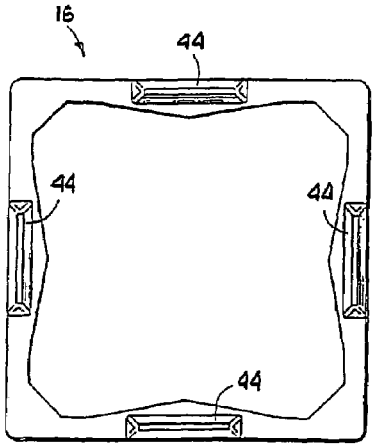

The ring beam 16, as shown in FIGS. 1, 2, 5 and 6, includes on its underside sixteen sockets 40 which are arranged in exactly the same configuration as the sockets 34 on the pallet base 12. The sockets 40 extend, as shown in FIG. 10, into the ring beam through formations 42 which project from the underside of the beam 16 towards the pallet base. The upper surface of the ring beam carries four upwardly projecting formations 44 which are releasably engageable in the recesses 32 in the undersides of the intermediate pallet base plinths 28, as shown in FIG. 10. As seen in FIGS. 3, 5 and 10 the ring beam formations 44 and the pallet base recesses 32 have four sides which are inclined towards their opposite sides for ease of engagement and release from one another.

The poles 14 are made from mild steel tubing which is suitably galvanised or.otherwise coated against atmospheric degradation and importantly their upper and lower ends are smoothly rounded as shown in FIG. 10 so as not to damage the plastic material in the sockets 34 and 40 in which they are located when what could be substantial compressive loads are imposed on them in their axial direction, in use, as will be explained below.

Figure 9:
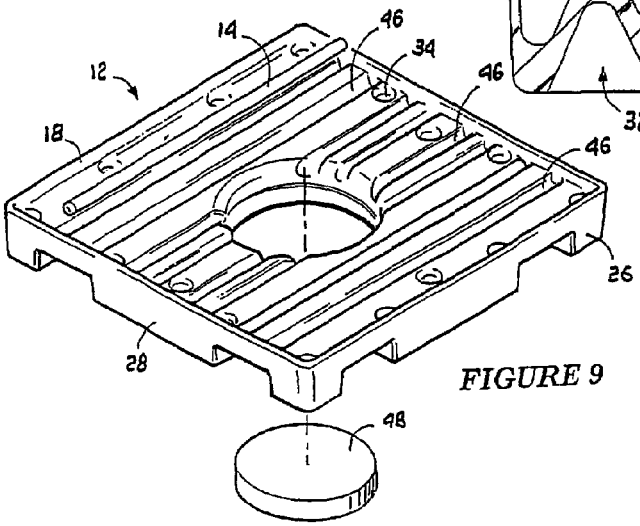
FIG. 9 is a perspective view from above of a variation of the pallet base of FIG. 7.

To accommodate the poles 14 in the knocked-down condition of the container framework the upper surface of the pallet base could include grooves 46, as shown in FIG. 9, which have rounded undersides and depth sufficient to contain the poles with their upper surfaces slightly below the upper surface of the pallet. Also, as shown in FIG. 9, the pallet base includes a closure plug 48 which is shown exploded from the pallet base in the drawing and which includes two or four diametrically opposite trunnions, not shown, which project radially from its circumferential periphery to be releasably engageable in bayonet-type slots, not shown, in the wall of the aperture 20 to enable the plug to be releasably locked into the aperture 20 from the underside of the pallet by upward and then rotational movement of the plug 48 by means of a handle which could be moulded into the underside of the plug 48.

The pallet base 12 of the container additionally includes a passive programmable microchip, not shown, which is embedded in its plastic material, after moulding, and which is programmed to provide its identity, storage information and the like on electronic interrogation.

The container bags 50 of the invention for use with the support structure thus far described may be made from a suitable plastics film material such as polyethylene with the gauge of the film being dependant on the nature of the material which the bag is to contain but will typically lie in a range of between 90 and 120 microns. Alternatively, again in dependence of the nature of the material which is to be loaded into the bag, the bag could be made from a suitably woven or net material or a combination of these materials, for example, in the transportation and storage of fresh produce such as oranges, mangoes, apples, pears and the like the bags would be made from a suitable netting to permit adequate ventilation through the fruit in the bag. Additionally, if the container is to contain liquid or particulate material, such as fertilizer, which is highly hydroscopic, the bag could be made from a robust woven plastics material which is laminated on its inner surface with an air impervious polypropylene film or if the bag is to be used to carry processed frozen vegetables it could be made from a suitable air impervious polyethylene.

Figure 12:
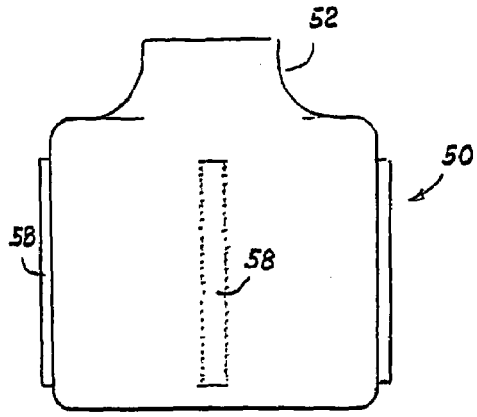
FIG. 12 is a perspective view from above of one embodiment of the bulk storage bag for use with the container of the invention.
Figure 13:
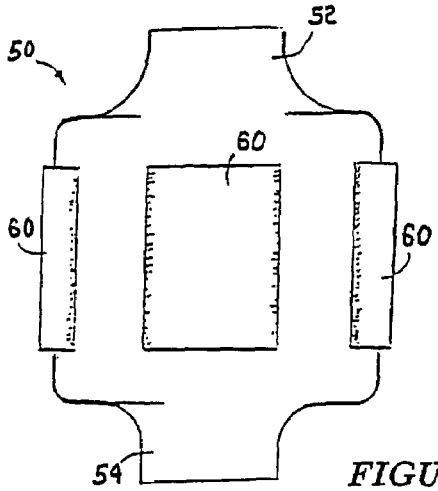
FIGS. 13 and 14 are side elevations of yet further embodiments of bags for use with the container of the invention.
Figure 14:
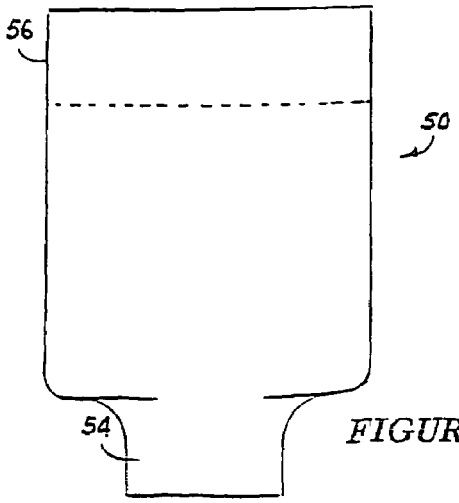

The bags 50 are made to be initially tubular and could include upper reduced diameter inlet tubes 52 as shown in FIG. 12 in which case their inwardly folded bases would need to be cut out or at least slit through the pallet base aperture 20 for bottom discharge. Alternatively, the bag 50 could have a reduced diameter outlet tube 54 which is inwardly folded to close over the closed plug 48 on the pallet base 12 with the tube merely unfolding to discharge when the plug 48 is removed. In its simplest form the bag 50, as shown in FIG. 14, could be made to include an outlet tube 54 and an upwardly extended side wall 56 which is open at the top and which, during loading of the bag in the support structure, is merely folded down over the ring beam 16 onto the outside side wall of the bag to be filled with the extended portion 56 of the bag then being folded back over the upper surface of the material loaded in it. The side walls of the bags could include circumferentially spaced vertical tubular sleeves 58 which may be made to receive a single pole 14 or sleeves 60 could be sized to receive two adjacent poles. The sleeves are made integral with the bag material by stitching or heat welding in dependence on the nature of the material from which the bag is made. Alternatively, the bags could include horizontal slits which are arranged in vertical rows about the periphery of the bag to suit a desired pole configuration when they are to be loaded with a low density particulate material which is not very flowable. In this case the poles are fed from the outside of the bag into and out of the horizontal slits in a row so that the bag will be supported by the material between the slits on the outside of the poles.

An important feature of the intermediate bulk container of this invention is that with the simple support structure of FIGS. 1 to 11 of the invention with pole arrangements as illustrated in FIGS. 15 to 18 and suitable bulk container bags 50 the user of the intermediate bulk container of the invention has a wide range of choices as to the type of container support structure required to transport and store a wide variety of discreet objects or types of particulate material.

Figure 15:
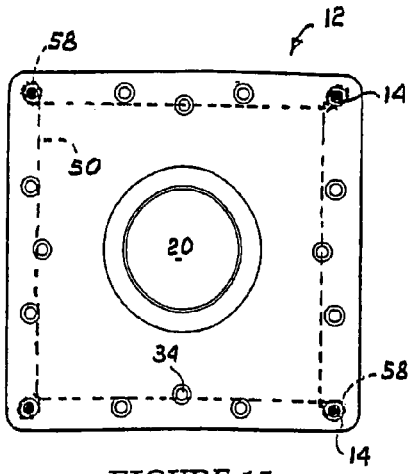
FIGS. 15 to 18 are plan views of the container base of the invention illustrating four bag support pole configurations.
Figure 16:
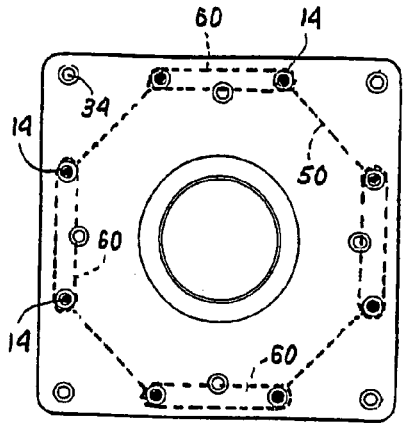
Figure 17:
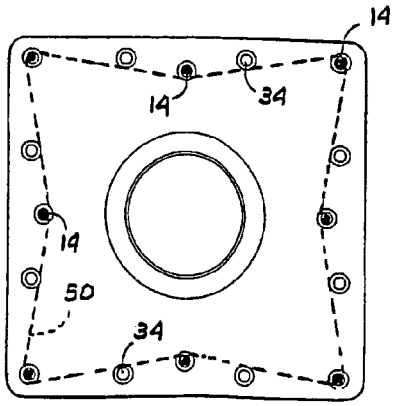

In FIGS. 15 and 16 the four pole configurations possible with the container support structure of the invention are illustrated by the blacked out poles. In FIG. 15 the support structure relies on four corner poles 14. The structure of FIG. 16 on four pairs of poles arranged in an octagonal configuration. In FIG. 17 on a different eight pole configuration to that of FIG. 16 and in FIG. 18 reliance is placed on a configuration employing all sixteen poles. In FIGS. 1, 2 and 3 the container is illustrated in the FIG. 17 configuration.

Figure 18:
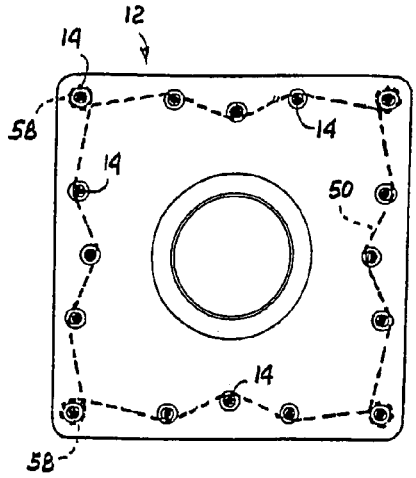

As an example of the versatility of the container of the invention, assuming it is desired to transport and store discreet objects such as low density table tennis or ping pong balls a simple pole structure such as the four pole structure of FIG. 15 would suffice in minimising the outward bulging of the container bags from between the poles 14. On the other hand, assuming that far denser golf balls were to be loaded into the containers a more robust and more closely spaced pole structure together with a heavier bag material would be required to minimise the outward bulging of the bag material from between the posts. In this case the eight pole configurations of FIGS. 16 and 17 would probably suffice. For very high density particulate material such as fertilizer and even grain or rice it may be required that the sixteen pole configuration of FIG. 18 is employed to inhibit excessive bag bulging.

With the above versatility of the container of the invention an organisation which is required to load a number of different materials into the containers of the invention need only keep suitable relatively cheap bags in stock to cater for the various materials for use with a compatible container support structure of the invention.

In confidential trials of the container of this invention for prospective customers, who had in the past used many types of intermediate bulk containers, surprisingly acceptable results, well beyond their expectations, were achieved with the trials being conducted according to criteria specified by the customers.

What particularly impressed the customers was:

(a) the low mass of the container, due to its plastic hollow moulded pallet base 12 and ring beam 16, (b) the versatility of the support structure and bag system of the containers in being able to cater for materials of various densities using a chosen variation of a single bag support structure, (c) the capability of a forklift being able, safely and without additional forklift lateral support, to convey three and at a push four loaded containers. With this being made possible by the interengagement of the pallet base and ring beam formations 32 and 44 respectively and the vertical rigidity of the support structure due to the depths of the pole 14 sockets 34 and 40 which ensure that the stacked containers form a cohesive, stable structure.

(d) the fact that seven containers could with absolute stability be stacked one on the other in a refrigerated or other storage facility. The seven container limitation was occasioned by this being the vertical limit to which a forklift could lift the containers for stacking. This feat is achievable by the load of the individual bags 50 of the stacked containers being fully supported on the pallet bases 12 of the containers and being transferred through the stack from the pallet bases to the axially aligned poles 14 of the containers in the stack and from the poles to the surface on which the stack rests through the support plinths 26 and 28 of the bottom container of the stack. This load transfer is without the load of the individual bags in the stack bearing on one another to unduly stress the flexible material from which the bags are made. This load transfer will be appreciated from FIG. 10 where it is seen that the pallet base 12 of one container 10 bears on the ring beam 16 of the container below it (dotted lines) in the stack. All of the poles 14 of the containers in the stack are in a single FIG. 15 to 18 configuration and are in axial register with the load of the loaded base pallets 12 being transmitted downwardly by the poles through the socket plugs 38 and the solid material of the pallet base and the ring beams to the stack supporting surface, and (e) the fact that administrative control of the containers and their contents was enormously simplified by the passive identity and storage information chips which were embedded in the container pallets.

Figure 11:
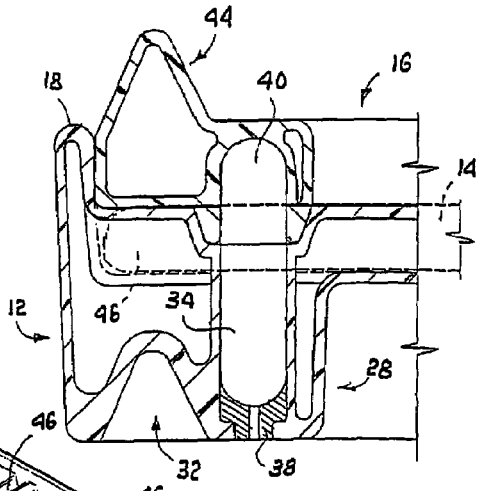
FIG. 11 is the same sectional view as that of FIG. 10 illustrating the ring beam nested on the FIG. 9 pallet base.

When the material in a container 10 of the invention has been emptied at its destination the ring beam 16 is lifted from the upper ends of the poles 14 and the poles are then lifted from their sockets 40 in the pallet base. The container bag is then removed from the pallet base. The poles 14 are then placed in the grooves 46 in the pallet base, see FIG. 9, and the ring beam is placed over them on the base and its socket projections 42 are pressed into the flared mouths 36 of the pallet base sockets 34, as shown in FIG. 11, to trap the poles in the pallet base grooves 46. A number of knocked-down pallets may be placed one on the other in a stack with the ring beam formations 44 located in the pallet base recesses 32 of the containers above them. The stacked containers may be strapped for shipping and the bottom pallet base in the stack will still be available for forklift handling.

The invention is not limited to the precise details as herein described. For example the storage container need not necessarily be a flexible bag and could, particularly for the storage and transport of liquids, be moulded from a non-rigid plastic material to include a suitable closable liquid inlet and outlet.

The invention claimed is:

1. An intermediate bulk container comprising a storage container which is made from a suitable flexible material, a forklift pallet base which is hollow moulded from a suitably rigid plastics material, is square or rectangular in plan and includes a plurality of pole engaging sockets in its upper surface which are arranged in a spaced relationship about its periphery, at least eight poles, the lower end of each of which is releasably engageable with a pole engaging socket on the pallet base to be perpendicular to the general plane of the upper surface of the pallet base to collectively provide a support cage for the storage container, a centrally holed pole location member which is hollow moulded from a suitably rigid plastics material to have the same outer shape and dimensions as the pallet base and includes a plurality of pole engaging sockets with which the upper ends of the poles are releasably engaged to lock the upper ends of the poles together to inhibit transverse outward bulging of the storage container from between the poles and to preserve the integrity of the container support cage against transverse loads imposed on it by a load in the storage container, the underside of the pallet base and the upper surface of the pole locating member include, adjacent their outer sides and centrally spaced from their corners, interengageable formations which are releasably engageable with compatible formations on intermediate bulk containers below and above it in a stack to prevent horizontally transverse dislocation of one container from another in the stack, the end portions of the poles are frictionally engaged, in use, in the sockets in the pallet base and the pole location member to inhibit skewing of the poles relatively to the components with which they are engaged, the pole location member includes outwardly projecting formations which face the pallet base and through which the pole sockets pass into the member to increase the length of the sockets in which the upper end portions of the poles are frictionally engaged, in use, and a portion of the lengths of the pole sockets in the pallet base, from their mouths in the upper surface of the pallet base, are dimensioned and shaped to receive the pole location member projecting formations when the pole location member is placed on the pallet base.

2. A bulk container as claimed in claim 1 wherein the upper surface of the pallet base includes, between the pole sockets, elongated recess in which poles may be stored and trapped by the pole location member when the pole location member is placed on the pallet base.

3. A bulk container as claimed in claim 2 wherein the pallet base and the pole location member each include sixteen pole engaging sockets which are arranged in sets of five alongside each of their four outer edges with the corner sockets each being common to two sets of sockets.

4. A bulk container as claimed in claim 3 wherein the central socket of each of the four sets of sockets is positioned closer to the centre of the pallet base and pole location member with the remaining sockets in each set being aligned and parallel to an outer edge of the pallet base and pole location member outwardly of its central socket.

* * * * *